United States Patent [19]

Menche

[11] Patent Number: 4,636,597

[45] Date of Patent: Jan. 13, 1987

[54] ELECTRICAL SNAP SWITCH

[75] Inventor: Edgar Menche, Luedenscheid, Fed. Rep. of Germany

[73] Assignee: Leopold Kostal GmbH & Co., KG, Fed. Rep. of Germany

[21] Appl. No.: 739,149

[22] Filed: May 30, 1985

[51] Int. Cl.[4] ..... H01H 5/00

[52] U.S. Cl. ..... 200/68.1; 200/67 D

[58] Field of Search ..... 200/68.1-68.3, 200/67 E, 67 R, 70, 77, 67 B, 153 L, 153 LA, 67 D

[56] References Cited

U.S. PATENT DOCUMENTS

| | | | |
|---|---|---|---|
| 2,513,804 | 7/1950 | Kaminky | 200/67 D |
| 2,870,282 | 1/1959 | Brand | 200/67 R |
| 3,336,449 | 8/1967 | Ashman | 200/67 D |
| 3,459,912 | 8/1969 | Bauer et al. | 200/67 D |
| 3,770,920 | 11/1973 | Poliak | 200/67 R |
| 4,061,895 | 12/1977 | Hults | 200/77 |

FOREIGN PATENT DOCUMENTS

| | | | |
|---|---|---|---|
| 321413 | 5/1920 | Fed. Rep. of Germany | 200/68.1 |
| 2257306 | 3/1980 | Fed. Rep. of Germany | 200/67 R |

*Primary Examiner*—Stephen Marcus
*Assistant Examiner*—Linda J. Sholl
*Attorney, Agent, or Firm*—Robert E. Knechtel; Basil E. Demeur

[57] ABSTRACT

An electrical snap switch having a pivotably mounted snap switch operating member which is acted upon by a switch spring assembly and which is provided with a wedge-shaped relief segment for interaction with a wedge-shaped relief segment provided on a sliding control member for the control of contact means. A one-piece elongated metal member is provided which serves alternatively as a contact means and as a switch spring means, whereby the snap switch is easy to mount and requires but few relatively simple component parts. The metal member includes a pull section for engagement with the switch operating member and a push section for engagement with a fixed contact member, its free end being provided with a plated contact to enable the metal element to bear against at least one fixed contact member.

4 Claims, 2 Drawing Figures

ELECTRICAL SNAP SWITCH

BACKGROUND OF THE INVENTION

The present invention relates to an improved electrical snap switch.

In a known snap switch, the sliding control member acts upon the switch spring assembly to cause a hinge point of the switch spring assembly to move overcenter so that upon passing the dead center position, an abrupt switching-over occurs.

As the hinge point moves into the dead center position the contact pressure necessarily decreases. This is undesirable especially for the reason that the transition resistance of the contact assembly changes correspondingly.

It has therefore been proposed to provide a snap switch in which the contact pressure during the switch-over transaction is at least maintained until up to the dead center position. This is accomplished by wedge-shaped relief segments provided on both the sliding control member and the snap switch operating member, with at least one relief segment being resiliently disposed against the action of the switch spring assembly.

Proceeding from the above state of the art, the object of the present invention is to provide further improvements to the switching mechanism to ensure a particularly easy mounting of the snap switch and to keep the number of necessary individual parts to a minimum.

The structural layout of an electrical snap switch in accordance with the present invention, is of great simplicity and is especially well suited for easy mounting because the switch comprises but a few uncomplicated individual parts. In particular, the heretofore necessary separate compressive spiral spring of the switch operating member is eliminated.

Further advantageous embodiments and features of the invention will become apparent from the following description when considered in connection with the drawings:

DESCRIPTION OF THE INVENTION

Figure 1:
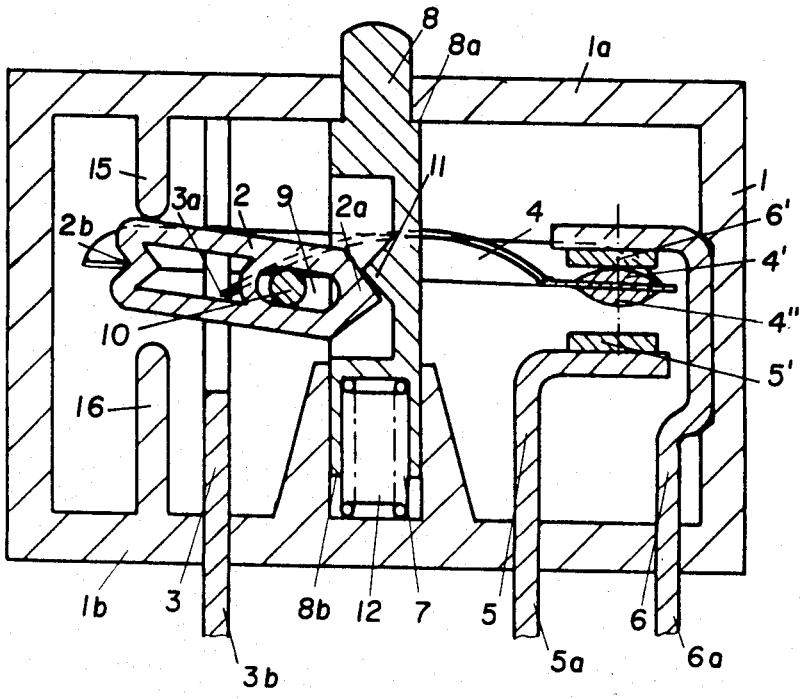
FIG. 1 is a sectional side view of the device of the invention.
Figure 2:
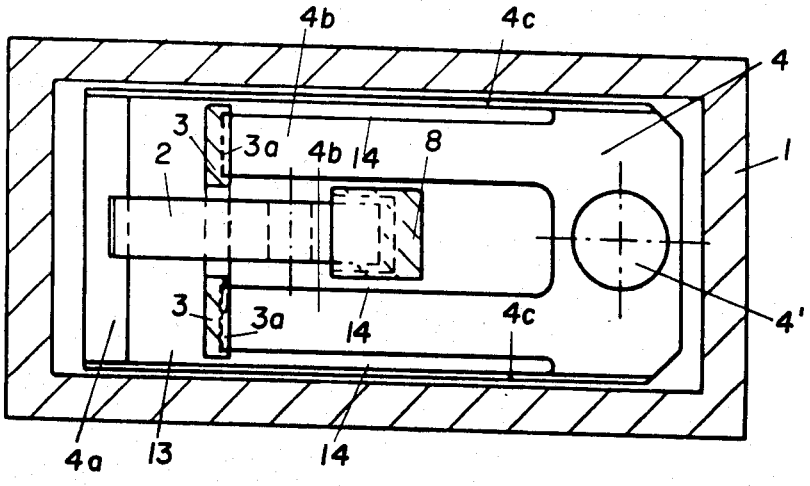
FIG. 2 is a sectional top plan view of the device of the invention.

Referring to the drawings, the electrical snap switch according to the invention is comprised substantially of a housing 1 made of a plastic material, a switch operating member 2 also made of a plastic material, and a metal element 4 which interacts with the switch operating member 2 and is mounted in a fixed contact member 3. The metal element 4 has the dual function of serving as a contact means, on the one hand, and as the snap spring means, on the other hand. The free end of the metal element 4 is associated with fixed contact members 5, 6 extending outwardly through the housing wall. A sliding control member 8 operates against the action of a return spring 7. The switch operating member 2 is provided with an elongated slot 9 and is mounted on an axis 10 in the housing so as to be pivotable and axially displaceable. One of its end portions is in the form of a wedge-shaped relief segment 2*a* for engagement with a similarly wedge-shaped relief segment 11 formed on the sliding control member 8. A hollow or chamber 12 provided in the sliding control member 8 serves to receive the return spring 7 in the form of a compressive spiral spring which urges a shoulder 8*a* of the sliding control member 8 against the housing top 1*a* in one operative switch position. In the other operative switch position, the bottom 1*b* of the housing 1 and the base 8*b* of the sliding control member 8 serve as abutments. The metal element 4 is of a configuration such that it has a pull and a push section. For this purpose the metal element 4 is provided with an opening 13 at the end opposite its free end to form a cross section or bar 4*a* oriented normal to longitudinal dimension of the metal element 4. The cross bar 4*a* engages a v-shaped notch 2*b* provided in the switch operating member 2. Two resilient bars 4*b* formed by cutouts 14 and projecting from the opening 13 in the longitudinal direction of the metal element 4 engage with their free ends a pair of mounts 3*a* provided on the fixed contact member 3 from which a terminal 3*b* extends outwardly through the housing wall 1. The metal element 4 is reinforced on each of its two longitudinal edges by an angular 90° strip 4*c* extending approximately the entire length of the metal element 4. The metal element 4 is further provided at its free end on the surfaces facing in opposite directions with a pair of plated contacts 4',4'' for interaction with two oppositely disposed plated contacts 5',6' provided on fixed contact members 5,6, the terminals 5*a*, 6*a* of which project outwardly from the housing 1.

In the initial position, the snap switch operating member 2 functions by means of the metal element 4 to electrically conductively connect the fixed contact members 3, 6 to each other.

Moving the sliding control member 8 in the direction of the arrow causes one flank of the wedge-shaped relief 11 formed on the sliding control member 8 to cam with the corresponding flank of the wedge-shaped relief 2*a* formed on the switch operating member 2. The latter is pushed back against the action of the resilient bars or fingers 4*b* of the metal element 4 into the elongated slot 9, causing the plated contact 4' of the element 4 to be displaced with respect to the plated contact 6' of the fixed contact member 6 until the dead center position of the switch operating member 2 is reached, without causing the contact pressure to drop. Only after the switch operating member 2 has been moved overcenter does it perform an abrupt stroke-like pivotal movement about its axis 10 whereby the plated contact 4'' of the metal element 4 is moved to interact with the plated contact 5' of the fixed contact member 5. This is due to the potential energy stored in the resilient fingers 4*b* of the element 4 and suddenly released, allowing the switch operating member 2 to spring into its other operative position, causing the other flank of the wedge-shaped relief 2*a* to move along the other flank of the wedge-shaped relief 11. In this operative position, the fixed contact members 3, 5 are electrically conductively connected to each other. The range of movement of the switch operating member 2 is limited by stops 15, 16. If the actuating force again is applied by the sliding control member 8, the sequence of movements of the operative parts of the switch is reversed.

I claim:

1. An electrical snap switch comprising in combination a substantially rectangularly-shaped switch operating (2), a sliding control member, and a switch spring assembly; said switch operating member having a wedge-shaped relief segment formed on one end of the segment, said switch operating member having an other end oscillatably mounted longitudinally between abutment members such that the other end upon operation of said switch operating member engages one of said abutment members, said switch operating member having an elongated slot for pivotally mounting said switch operating member on an axis, said switch operating member being acted upon by said switch spring assembly and being in communication with contact means to enable said switch operating member to connect in at least one of its end positions at least one pair of fixed contact members to each other, said sliding control member (8) being acted upon by a return spring, disposed between said switch operating member and said fixed contact members, and being movable approximately normal to the longitudinal extension of the snap switch operating member to act upon the switch spring assembly, said sliding control member having formed thereon a wedge-shaped relief segment for interaction with said wedge-shaped relief segment of the switch operating member which is axially displaceably mounted about its pivot axis, said switch spring assembly characterized by a one-piece elongated metal element (4) which serves the dual purpose to act as contact means and to function as a switch spring device, said metal element (4) having a pull section (4*a*) engaging said other end of the snap switch operating member (2) and a push section (4*b*) for engaging a fixed contact member (3), said metal element (4) being adapted to make contact by means of at least one of the plated contacts (4', 4'') provided on its free end with at least one fixed contact member (5, 6).

2. The electrical snap switch according to claim 1, characterized in that said metal element (4) is provided at the end opposite its free end with an opening (13) to form a cross bar (4*a*) which extends normal to the longitudinal extension of the metal element (4) and is adapted to engage a v-shaped notch (2*b*) provided at said other end of the switch operating member (2), said metal element (4) being further provided with a pair of finger-like bars (4*b*) proceeding from said opening (13) and generated by cutouts (14), said fingers (4*b*) extending on each side of the snap switch operating member (2) and the sliding control member (8) in the direction toward the end of the metal element (4) that has at least one contact plating (4' 4'') applied thereto, the free ends of said fingers (4*b*) being insertable in mounts (3*a*) provided at the fixed contact element (3).

3. The electrical snap switch according to claim 2, characterized in that the switch element interacting with the fingers (4*b*) of the metal element (4) consists of one of the fixed contact members (3).

4. The electrical snap switch according to claim 1, characterized in that the metal element (4) is provided on each of its two longitudinal edges with a reinforcement strip (4*c*) which is angularly bent by 90° along the same direction.

* * * * *